US009340884B2

(12) United States Patent
Aust et al.

(10) Patent No.: US 9,340,884 B2
(45) Date of Patent: May 17, 2016

(54) PROCESS FOR THE ELECTROCHEMICAL FLUORINATION OF ORGANIC COMPOUNDS

(75) Inventors: Nicola Christiane Aust, Mannheim (DE); Itamar Michael Malkowsky, Speyer (DE)

(73) Assignee: BASF SE, Ludwigshafen (DE)

( * ) Notice: Subject to any disclaimer, the term of this patent is extended or adjusted under 35 U.S.C. 154(b) by 1153 days.

(21) Appl. No.: 13/316,864

(22) Filed: Dec. 12, 2011

(65) Prior Publication Data

US 2012/0152757 A1 Jun. 21, 2012

Related U.S. Application Data

(60) Provisional application No. 61/423,125, filed on Dec. 15, 2010.

(51) Int. Cl.
*C25B 3/08* (2006.01)

(52) U.S. Cl.
CPC ..... *C25B 3/08* (2013.01)

(58) Field of Classification Search
CPC ..... C25B 3/08
USPC ..... 205/430, 460, 401, 405, 431, 435, 436, 205/438
See application file for complete search history.

(56) References Cited

U.S. PATENT DOCUMENTS

| | | | | |
|---|---|---|---|---|
| 2,519,983 | A | 8/1950 | Simons | |
| 3,511,761 | A * | 5/1970 | Ruehlen et al. | 205/430 |
| 4,146,443 | A | 3/1979 | Childs | |
| 4,929,317 | A * | 5/1990 | Nishimura et al. | 564/412 |
| 5,573,654 | A * | 11/1996 | Cheburkov et al. | 205/430 |
| 5,618,392 | A * | 4/1997 | Furuya | 204/252 |
| 2009/0143613 | A1* | 6/2009 | Uotani et al. | 562/113 |
| 2011/0143220 | A1 | 6/2011 | Steimle et al. | |
| 2011/0260100 | A1 | 10/2011 | Trukhan et al. | |

FOREIGN PATENT DOCUMENTS

| | | | | |
|---|---|---|---|---|
| WO | WO 98/00580 | A1 | 1/1998 | |
| WO | WO 9800580 | A1 * | 1/1998 | C25B 9/00 |
| WO | 2010/106072 | A2 | 9/2010 | |
| WO | 2010/106072 | A3 | 9/2010 | |
| WO | 2010/121899 | A1 | 10/2010 | |
| WO | 2010/139685 | A1 | 12/2010 | |
| WO | 2011/073113 | A1 | 6/2011 | |
| WO | 2011/132147 | A1 | 10/2011 | |

OTHER PUBLICATIONS

Meurs et al, Tetrahedron, 47, 4/5, 705-714, 1991.*
Hasegawa et al, Journal of the Electrochemical Society, 153(10), 2006, D162-D165.*
Hydrogen Fluoride, Technical Data Sheet, by Solvay, date not available.*
Meurs et al., "Oxidative Fluorination in Amine-HF Mixtures," Tetrahedron (no month, 1991), vol. 47, No. 4/5, pp. 705-714.*
Hasegawa et al., "Regioselective Anodic Monofluorination of Ethers, Lactones, Carbonates, and Esters Using Ionic Liquid Fluoride Salts," Journal of the Electrochemical Society (no month, 2006), vol. 153 (10), pp. D162-D166.*
U.S. Appl. No. 13/916,748, filed Jun. 13, 2013, Aust, et al.
International Search Report and Written Opinion issued Mar. 27, 2012 in PCT/EP2011/072682.
International Preliminary Report on Patentability issued Feb. 15, 2013 in PCT/EP2011/072682.
Masaru Hasegawa et al., "Regioselective Anodic Monofluorination of Ethers, Lactones, Carbonates, and Esters Using Ionic Liquid Fluoride Salts", Journal of the Electrochemical Society, vol. 153, No. 10, XP-002670543, Aug. 2, 2006, pp. 162-166.
U.S. Appl. No. 13/257,092, filed Sep. 16, 2011, Aurelie Alemany, et al.
U.S. Appl. No. 13/265,412, filed Oct. 20, 2011, Itamar Michael Malkowsky, et al.
U.S. Appl. No. 13/375,495, filed Dec. 1, 2011, Andreas Fischer, et al.
J. H. Simons et al., "The Electrochemical Process for the Production of Fluorocarbons", J. Electrochem. Soc., 1949, vol. 95, pp. 47-52.
Enno Hollitzer et al., "Die Elektrochemische Fluorierung—ein Überblick", Chem.-Ing.-Tech., 1986, vol. 58, pp. 31-38.
Jan H. H. Meurs et al., "Oxidative Fluorination in Amine-HF Mixtures", Tetrahedron, 1991, vol. 47, No. 4/5, pp. 705-714.
Shinsuke Inagi et al., "Effects of Additives on Anodic Fluorination in Ionic Liquid Hydrogen Fluoride Salts", Electrochemistry Communications, 2008, vol. 10, pp. 1158-1160.
Toshio Fuchigami, "Unique Solvent Effects on Selective Electrochemical Fluorination of Organic Compounds", Journal of Fluorine Chemistry, 2007, vol. 128, pp. 311-316.
U.S. Appl. No. 14/559,020, filed Dec. 3, 2014, Steimle, et al.

* cited by examiner

*Primary Examiner* — Edna Wong
(74) *Attorney, Agent, or Firm* — Oblon, McClelland, Maier & Neustadt, L.L.P.

(57) ABSTRACT

The present invention relates to a process for the electrochemical fluorination of an organic compound, wherein a reaction solution comprising the organic compound and a fluorinating agent is subjected to electric current in an electrochemical fluorination cell.

12 Claims, No Drawings

PROCESS FOR THE ELECTROCHEMICAL FLUORINATION OF ORGANIC COMPOUNDS

FIELD OF THE INVENTION

The present invention relates to a process for the electrochemical fluorination of an organic compound, wherein a liquid reaction medium comprising the organic compound and a fluorinating agent is being electrolyzed.

BACKGROUND OF THE INVENTION

Fluorochemicals (in particular partly fluorinated and perfluorinated organic compounds) are commercially valuable and useful chemical materials. Fluorochemicals can exhibit various useful properties, e.g., they may be inert, nonpolar, hydrophobic, oleophobic, etc. As such, fluorochemicals have found a wide variety of applications, e.g. as oil, water and stain resistant chemicals, as refrigerants and heat exchange agents or as solvents and cleaning agents. Fluorinated heterocyclic compounds have found wide use as pharmaceuticals and agrochemicals due to their high and specific physiological activity. Because of the versatility of fluorochemicals and consequently a strong demand for these materials, there is a continuing need for new and/or improved methods for their preparation.

DESCRIPTION OF THE RELATED ART

One well-known industrial process for preparing fluorochemical compounds is the electrochemical perfluorination process developed in the 1940s by John Simons (J. H. Simons, J. Electrochem. Soc. 1949, 95, 47-52), often referred to as Simons fluorination or electrochemical fluorination (ECF). According to this method, an electrolyte solution containing a mixture of liquid anhydrous hydrogen fluoride and an organic compound intended to be fluorinated is subjected to electrolysis. Generally, the Simons process is practiced at nickel electrodes with a constant current passed through the electrolyte. The current passing through the electrolyte causes one or more of the hydrogen atoms of the organic compound to be replaced by fluorine atoms.

A further principal electrochemical method for introducing fluorine directly into organic compounds is the electrolysis in salt melts, e.g. in potassium fluoride/hydrogen fluoride melts, using porous carbon anodes. This method is also known as Phillips process.

For partial fluorine substitution it is known to employ electrolysis in fluoride ion solutions, namely HF complexes using platinum electrodes. Though other electrode materials are described in the patent and non-patent literature, platinum is the electrode of choice in most actual partial electrochemical fluorinations (E. Hollitzer, P. Sartori, Chem.-Ing.-Tech. 1986, 58, 31-38).

One advantage of platinum electrodes is their high degree of stability against HF complexes. J. H. H. Meurs and W. Eilenberg describe in Tetrahedron, Vol. 47, No. 4/5, pp. 705-714, 1991, methods for the oxidative fluorination in amine-HF mixtures. Electrode materials which were found to be stable using $(C_2H_5)_3N.3$ HF in the electrofluorination of benzene were vitreous carbon (which rapidly degrades in electrolytes with higher HF content) and platinum deposited on a copper base. The lifetime of graphite electrodes did not exceed 10 minutes.

Although fluorination processes with platinum electrodes allow reactions with certain selectivity, it is generally difficult to introduce one or more fluorine atoms only or predominantly at the desired position in an organic compound by electrolysis. In many cases the obtained selectivity and/or conversion rate is low. To overcome these problems different fluorinating agents have been developed, wherein HF is complexed with amine bases, like $(C_2H_5)_3N.m$ HF, wherein m denotes the moles of HF molecules the complex comprises (e.g. 2, 3, 4, 5 or 6). The HF complexes can be employed as electrolyte and fluorinating agent and at the same time also as solvent. Thus, the electrochemical fluorination with HF complexes can be performed in the absence of solvents. In a different variant, the electrochemical fluorination with HF complexes is performed in an aprotic solvent.

The complexation of HF leads often to an increased selectivity. On the other hand, the reactivity of the fluorinating agent and the conversion rate of the fluorination reaction are in many case decreased by the complexation of HF. In some cases low selectivity and low conversion rates are improved by the use of HF complexes with a high HF content, e.g. $(C_2H_5)_4NF.5$ HF. Nevertheless, the success of this strategy depends on the substrate employed for the electrochemical fluorination. Further, an important drawback of HF complexes with a high HF content is their higher corrosivity compared to complexes with a lower HF content, like $(C_2H_5)_3N.3$ HF. There is a need for materials and in particular electrodes that have an enhanced lifetime if they are employed in this kind of electrochemical fluorination.

It is known that the choice of an appropriate solvent, e.g. dimethoxyethane or other ether-containing additives with coordination ability to cations and anodic stability, can improve the selectivity of the ECF (S. Inagi, T. Sawamura, T. Fuchigami, Electrochemistry Communications 10 (2008), 1158-1160). Also the use of additives like ionic liquids can have a positive effect on the selectivity and/or conversion rate of the ECF. T. Fuchigami describes in Journal of Fluorine Chemistry 2007, 128, 311-316 solvent effects on the selectivity of the electrochemical fluorination of organic compounds. It was found that a combination of $(C_2H_5)_3N.n$ HF (n=3-5) and [EMIM][OTf] markedly increased the yield of the mono-fluorination product of phthalide. Drawbacks in the industrial utilization are that these additives cause additional costs and have to be separated after the electrolysis.

There is still a great need for an effective method that allows the electrochemical fluorination of organic compounds with a high selectivity and/or a high conversion rate of the fluorination reaction. Preferably, this method should also allow a long lifetime of the employed electrodes.

It has now been found that, surprisingly gas diffusion layers (GDL) are advantageously suitable for the use as the anode in electrochemical fluorination processes. They show a high degree of stability against most fluorinating agents and in particular amine-HF complexes. Electrochemical fluorination processes wherein a GDL electrode is employed are usually characterized by a high selectivity in view of a certain product. Further, electrochemical fluorination processes wherein a GDL electrode is employed usually show high conversion rates. Advantageously, the process of the invention allows the use of HF complexes with a lower HF content, like $(C_2H_5)_3N.3$ HF. Even with HF complexes with a lower HF content and without addition of solvents or other additives conversion and/or selectivity of the electrochemical fluorination are improved.

SUMMARY OF THE INVENTION

In a first aspect, the invention provides a process for the electrochemical fluorination of an organic compound comprising the steps of:

a) providing an organic compound comprising at least one hydrogen atom bound to a carbon atom;

b) providing, in an electrochemical cell comprising a cathode and an anode, a liquid reaction medium comprising the organic compound and a fluorinating agent;

c) electrolyzing the liquid reaction medium to cause replacement of at least a part of said hydrogen atoms with fluorine atoms, characterized in that a gas diffusion layer is used as the anode.

In a further aspect, the invention provides the use of a gas diffusion layer electrode in a process for the electrochemical fluorination of an organic compound to improve the selectivity and/or conversion rate of the fluorination reaction.

DETAILED DESCRIPTION

In the context of the present invention, the expression $C_1$-$C_6$-alkyl comprises straight-chain or branched $C_1$-$C_6$-alkyl groups. Examples of $C_1$-$C_6$-alkyl groups are methyl, ethyl, n-propyl, isopropyl, n-butyl, isobutyl, sec-butyl, tert-butyl, n-pentyl, neo-pentyl and n-hexyl.

The above remarks regarding alkyl also apply to the alkyl moiety in alkoxy.

In the context of the present invention, the term "cycloalkyl" denotes a cycloaliphatic radical having usually from 3 to 12 carbon atoms, preferably 5 to 8 carbon atoms, such as cyclopropyl, cyclobutyl, cyclopentyl, cyclohexyl, cycloheptyl, cyclooctyl, norbornyl, bicyclo[2.2.2]octyl or adamantyl.

In the context of the present invention, the term $C_6$-$C_{10}$-aryl refers to mono- or polycyclic aromatic hydrocarbon radicals. $C_6$-$C_{10}$-aryl is preferably phenyl or naphthyl.

It is a critical feature of the process according to the invention to employ an electrochemical cell (electrolysis cell) that comprises at least one GDL electrode as anode.

GDLs are known to a person skilled in the art and are commercially available. Suitable GDLs are described inter alia in U.S. Pat. No. 4,748,095, U.S. Pat. No. 4,931,168 and U.S. Pat. No. 5,618,392. The teaching of those documents is incorporated herein by reference. Suitable commercially available GDLs are e.g. of the H2315 series from Freudenberg FCCT KG, Höhner Weg 2-4, 69465 Weinheim, Germany.

A GDL generally comprises a fibre layer or substrate and a microporous layer (MPL) consisting of carbon particles attached to each other. The degree of hydrophobization can vary in such a way that wetting and gas permeability can be adjusted.

GDL electrodes for the process of the invention preferably do not contain a catalyst supported on the surface of the electrode.

The use of at least one GDL electrode in the process of the invention has a positive effect on at least one of the following parameters: selectivity of the electrofluorination, conversion rate of the fluorination reaction, space-time yield, and service life of the cell. While not being bound to any theory it is assumed, that intermediates of the fluorination reaction of the organic compound, e.g. cation-radicals generated during the anodic oxidation step, are stabilized by the GDL electrode.

As cathode any electrode suitable for electrochemical fluorination processes can be used. A person skilled in the art can determine which electrode is suitable. Preferably, the cathode is selected from Pt, Pb, Ni, steel and GDL electrodes.

Step a)

The organic compound provided in step a) can generally be any organic compound that comprises at least one hydrogen atom directly bound to a carbon atom that can be substituted by fluorine under the conditions of the electrochemical fluorination. It is of course also possible to employ a mixture of organic compounds. Suitable are organic compounds that in combination with at least one fluorinating agent and optionally solvents and/or additives allow the formation of a liquid reaction medium with ionic conductivity so that electrolysis can be applied to cause fluorination of the organic compound(s).

The liquid reaction medium within the electrochemical fluorination cell includes an electrolyte phase comprising HF and an amount of organic compound solubilized therein. The organic compound can be in the form of a liquid, solid, or gas, and can be introduced to the hydrogen fluoride as appropriate for its physical state.

The organic compound can comprise functional groups that are essentially stable under the reaction conditions. Suitable functional groups comprise carbonyl, thiocarbonyl, ester, thioester, amide, oxycarbonyloxy, urethane, urea, hydroxyl, sulfonyl, sulfinate, sulfonate, sulfate, ether, amine, nitrile, etc. and combinations thereof.

Preferably, the organic compound provided in step a) is selected from compounds of the general formula I

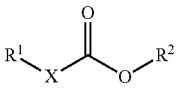

(I)

wherein

X is O, N—$R^3$ or $CR^4R^5$, $R^1$ is selected from $C_1$-$C_6$-alkyl, $C_1$-$C_6$-alkoxy-$C_1$-$C_6$-alkyl, formyl, $C_1$-$C_6$-alkylcarbonyl and $C_1$-$C_6$-alkyloxycarbonyl, wherein $R^1$ may also be $C_1$-$C_6$-alkoxy if X is a $CR^4R^5$ group, wherein $R^1$ may also be $C_1$-$C_6$-alkylcarbonyloxy if X is a N—$R^3$ or $CR^4R^5$ group, $R^2$ is selected from hydrogen, $C_1$-$C_6$-alkyl, $C_1$-$C_6$-alkoxy-$C_1$-$C_6$-alkyl, $C_6$-$C_{10}$-aryl-$C_1$-$C_6$-alkyl, $C_3$-$C_{12}$-cycloalkyl and $C_6$-$C_{10}$-aryl, $R^3$ is selected from hydrogen, $C_1$-$C_6$-alkyl, $C_1$-$C_6$-alkoxy-$C_1$-$C_6$-alkyl, formyl, $C_1$-$C_6$-alkylcarbonyl and $C_1$-$C_6$-alkyloxycarbonyl, $R^4$ and $R^5$ are independently selected from hydrogen, $C_1$-$C_6$-alkyl, $C_1$-$C_6$-alkoxy-$C_1$-$C_6$-alkyl and $C_1$-$C_6$-alkoxy, or $R^1$ and $R^2$ together with the X—(C═O)—O group to which they are bound form a 5- to 7-membered heterocyclic ring, which may contain at least one additional heteroatom or heteroatom containing group, selected from O, S, $NR^a$ or C═O, wherein $R^a$ is selected from hydrogen, alkyl, cycloalkyl and aryl, or X is a $CR^4R^5$ group and $R^1$ and $R^4$ together with the carbon atom to which they are bound form a 3 to 7 membered carbocyclic ring.

Preferably, X is O, $CH_2$ or $NR^3$, wherein $R^3$ is $C_1$-$C_4$-alkyl or $C_1$-$C_4$-alkylcarbonyl. In particular, X is $NR^3$, wherein $R^3$ is methyl, ethyl, n-propyl, n-butyl, methylcarbonyl or ethylcarbonyl.

In a preferred embodiment, $R^1$ and $R^2$ together with the X—(C═O)—O group to which they are bound form a 5 to 7 membered heterocyclic ring, which may contain at least one additional heteroatom or heteroatom containing group, selected from O, S, $NR^a$ or C═O, wherein $R^a$ is selected from hydrogen, alkyl, cycloalkyl or aryl. In this embodiment, X is preferably O, $CH_2$ or N—$R^3$, wherein $R^3$ is $C_1$-$C_4$-alkyl or $C_1$-$C_4$-alkylcarbonyl. Further, in this embodiment $R^1$ and $R^2$ together are selected from groups of the formulae —$CH_2$—$CH_2$—, —$CH_2$—$CH_2$—$CH_2$— and —$CH(C_xH_{2x+1})$—$CH_2$—, wherein x is 1, 2, 3 or 4.

In a further preferred embodiment, $R^1$ is selected from $C_1$-$C_4$-alkyl. In particular $R^1$ is selected from methyl, ethyl, n-propyl and n-butyl.

In a further preferred embodiment, X is a $CH_2$ group and $R^1$ is selected from hydrogen, $C_1$-$C_4$-alkyl, $C_1$-$C_4$-alkoxy, formyl, $C_1$-$C_4$-alkylcarbonyl and $C_1$-$C_4$-alkyloxycarbonyl. In particular, X is a $CH_2$ group and $R^1$ is selected from hydrogen, methyl, ethyl, n-propyl, n-butyl, methoxy, ethoxy, n-propyloxy, n-butyloxy, formyl, methylcarbonyl, ethylcarbonyl, methoxycarbonyl and ethoxycarbonyl.

In a further preferred embodiment, X is a $CR^4R^5$ group and $R^1$ and $R^4$ together with the carbon atom to which they are bound form a 3 to 7 membered carbocyclic ring. In this embodiment, $R^1$ and $R^4$ together with the carbon atom to which they are bound form a cyclopropyl ring. Further, in this embodiment, preferably $R^5$ is hydrogen.

Preferably, $R^2$ is selected from $C_1$-$C_4$-alkyl. In particular $R^2$ is selected from methyl, ethyl, n-propyl and n-butyl.

Examples of suitable organic compounds are:

(1)

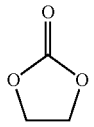

(2)

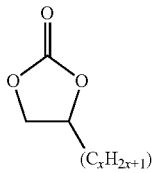

(x = 1, 2, 3, 4)

(3)

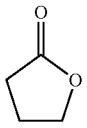

(4)

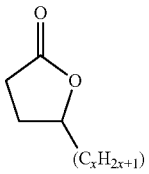

(x = 1, 2, 3, 4)

(5)

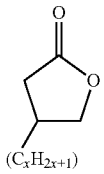

(x = 1, 2, 3, 4)

-continued (6)

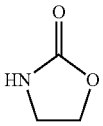

(7)

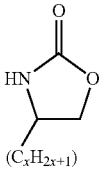

(x = 1, 2, 3, 4)

(8)

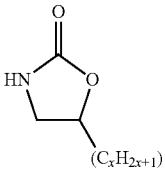

(9)

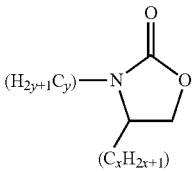

(10)

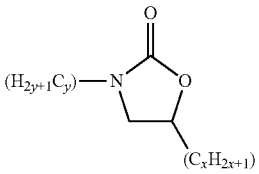

(x = 1, 2, 3, 4)
(y = 1, 2, 3, 4)

(11)

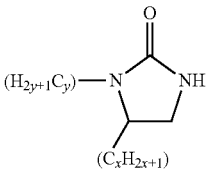

(12)

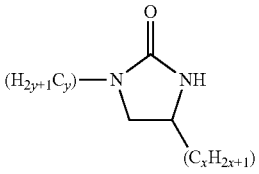

(x = 1, 2, 3, 4)
(y = 1, 2, 3, 4)

(13)

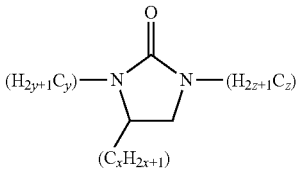

(x = 1, 2, 3, 4)
(y = 1, 2, 3, 4)
(z = 1, 2, 3, 4)

-continued (14)

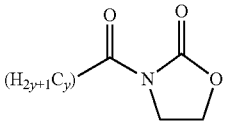

(y = 1, 2, 3, 4)

(15)

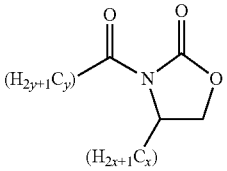

(x = 1, 2, 3, 4)
(y = 1, 2, 3, 4)

(16)

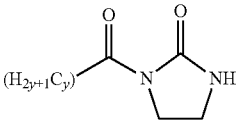

(y = 1, 2, 3, 4)

(17)

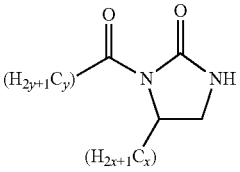

(x = 1, 2, 3, 4)
(y = 1, 2, 3, 4)

(18)

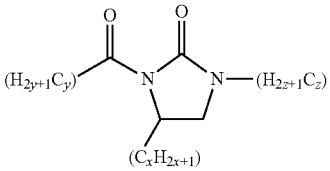

(x = 1, 2, 3, 4)
(y = 1, 2, 3, 4)
(z = 1, 2, 3, 4)

(19)

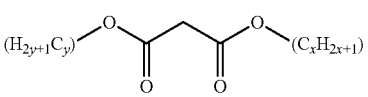

(x = 1, 2, 3, 4)
(y = 1, 2, 3, 4)

The organic compound provided in step a) is preferably ethylene carbonate or propylene carbonate (4-methyl-1,3-dioxolan-2-one).

Step b)

In step b) of the process according to the invention, a liquid reaction medium comprising the organic compound and a fluorinating agent is provided.

The fluorinating agent employed in step b) can be any agent or mixtures of agents which is capable to substitute a hydrogen atom with a fluorine atom during the electrochemical fluorination.

Preferably, the fluorinating agent is selected from complexes of HF with amine bases. Preferred are complexes of HF with trialkylamines, ammonium fluorides, pyridine and mixtures thereof. In particular, the HF-complex is selected from polyhydrofluoride complexes of trialkylamines and tetraalkylammoniumfluorides.

Advantageously, the process of the invention allows the use of HF complexes with a low HF content. Thus, in a preferred embodiment, $(C_2H_5)_3N.3$ HF is employed as the HF-complex.

The molar ratio of fluorinating agent (with regard HF) to organic compound is preferably in the range from 1:1 to 99:1 (fluorinating agent:organic compound), more preferably from 50:25 to 99:1.

In the context of the present invention, the expression "liquid reaction medium" denotes a reaction medium that comprises a liquid phase under the reaction conditions of the fluorination reaction. This liquid phase contains a sufficient amount of the organic compound to allow electrochemical fluorination. It is not necessary that the liquid phase contains the organic compound in form of a homogeneous solution, as long as a sufficient amount of the organic compound is brought in contact with the electrodes of the electrochemical cell, in particular the anode. Thus, the liquid reaction medium may contain the organic compound in form of a homogeneous solution, colloidal solution, molecularly disperse solution, emulsified phase or disperse phase. Finally, it is also possible to introduce a gaseous stream containing the organic compound into the liquid reaction medium.

In comparison to processes known from the prior art, the process according to the invention does not require any additional solvents or additives to establish a fluorination reaction with high conversion rates and good selectivity. In particular, the HF complex employed as fluorinating agent may also function as conducting salt (electrolyte) and/or as solvent.

Preferably, the liquid reaction medium provided in step b) comprises in essence no additional solvents and other additives, i.e. the proportion of solvents and other additives is below 1% by weight, based on the total weight of the liquid reaction medium.

If the reaction medium provided in step b) contains an organic solvent, it is preferably selected from acetonitrile, ethers, halogenated alkanes, sulfolane, ionic liquids and mixtures thereof.

If at least one HF complex is employed as fluorinating agent, the liquid reaction medium is generally sufficiently electrically conductive to allow electrolysis in an amount sufficient to result in fluorination of the organic compound.

An overview on the construction possibilities of electrolysis cells that are suitable as electrochemical fluorination cells for the process of the invention can be found, for example, in D. Pletcher, F. Walsh, Industrial Electrochemistry, 2nd Edition, 1990, London, pp. 60ff.

Suitable electrochemical cells for the electrochemical fluorination are undivided cells and divided cells. An undivided cell usually comprises only one electrolyte portion; a divided cell has two or more such portion. The individual electrodes can be connected in parallel (monopolar) or serially (bipolar). In a suitable embodiment, the electrochemical cell employed for the fluorination is a monopolar cell comprising a GDL anode and a cathode. In a further suitable embodiment, the electrochemical cell employed for the fluorination is a cell having bipolar connection of the stacked electrodes.

In a preferred embodiment, the electrochemical fluorination cell is a plate-and-frame cell. Plate-and-frame cells employed in the process of the invention comprise at least one GDL electrode. This type of cell is composed essentially of usually rectangular electrode plates and frames which surround them. They can be made of polymer material, for example polyethylene, polypropylene, polyvinyl chloride, polyvinylidene fluoride, PTFE, etc. The electrode plate and the associated frame are frequently joined to each other to form an assembly unit. By pressing a plurality of such plate-and-frame units together, a stack which is assembled according to the constructional fashion of filter presses is obtained. Yet further frame units, for example for receiving spacing gauzes, etc. can be inserted in the stack.

Step c)

The process according to the invention can be performed according to known methods for the electrochemical fluorination of organic compounds by electrolyzing the liquid reaction medium in order to cause replacement of at least a part of the carbon bound hydrogen atoms with fluorine atoms, with the proviso that the employed electrochemical fluorination cell comprises at least a GDL anode.

One or more anodes and one or more cathodes are placed in the liquid reaction medium. According to the invention, at least the anode is a GDL electrode. An electric potential (voltage) is established between the anode(s) and cathode(s), resulting in an oxidation reaction (primarily fluorination, i.e., replacement of one or more carbon bound hydrogen atoms with carbon bound fluorine atoms) at the anode, and a reduction reaction (primarily hydrogen evolution) at the cathode.

Preferably, the electrochemical fluorination is performed with a constant current applied; i.e. at a constant voltage and a constant current flow. It is of course also possible, to interrupt the electric current through a current cycle, as described in U.S. Pat. No. 6,267,865.

Preferably, the current density employed in step c) is in a range of from 10 to 250 mA/cm$^2$.

The fluorination products can be separated from the reaction medium by customary methods, preferably by distillation. The distillation of the reaction discharge can be carried out by customary methods known to those skilled in the art. Suitable apparatuses for the fractionation by distillation comprise distillation columns such as tray columns, which can be provided with bubble caps, sieve plates, sieve trays, packings, internals, valves, side offtakes, etc. Dividing wall columns, which may be provided with side offtakes, recirculations, etc., are especially suitable. A combination of two or more than two distillation columns can be used for the distillation. Further suitable apparatuses are evaporators such as thin film evaporators, falling film evaporators, Sambay evaporators, etc, and combinations thereof.

The following examples are intended for further illustration of the present invention.

Example 1

4-fluoroethylene carbonate

In a 100 ml undivided electrolysis cell 30.2 g ethylene carbonate and 40 g triethylamine tris(hydrogenfluoride) were electrolyzed for 2 F using a GDL electrode (H2315 IX 11 CX108 from Freudenberg, 10 cm$^2$) as anode and a Pb cathode (10 cm$^2$). The current density was 100 mA/cm$^2$. Afterwards the electrolysis output was stirred with 60 g ice water, three times extracted with 50 ml ethyl acetate and dried over magnesium sulphate. After removing the ethyl acetate by distillation a crude mixture showed 66% conversion of ethylene carbonate, 61% selectivity towards 4-fluoroethylene carbonate which resulted in a yield of 40%.

Comparative Example C-1

In a 100 ml undivided electrolysis cell 30.2 g ethylene carbonate and 40 g triethylamine tris(hydrogenfluoride) were electrolyzed for 2 F using platinum electrodes (10 cm$^2$) as anode and cathode. The current density was 100 mA/cm$^2$. Afterwards the electrolysis output was stirred with 60 g ice water, three times extracted with 50 ml ethyl acetate and dried over magnesium sulphate. After removing the ethyl acetate by distillation a crude mixture showed 28% conversion of ethylene carbonate, 24% selectivity towards 4-fluoroethylene carbonate which resulted in a yield of 7%.

Examples 2 and 3

According to the procedure described in example 1 the electrochemical fluorination of ethylene carbonate was repeated with different pairs of electrodes.

TABLE 1 electrochemical fluorination of different organic compounds

| Example | anode | cathode | fluorinating agent | conversion [%] | selectivity [%] | yield [%] |
|---|---|---|---|---|---|---|
| 1 | GDL | Pb | $Et_3N$ * 3 HF | 66 | 61 | 40 |
| C-1$^{+)}$ | Pt | Pt | $Et_3N$ * 3 HF | 28 | 24 | 7 |
| 2 | GDL | GDL | $Et_3N$ * 3 HF | 55 | 54 | 30 |
| 3 | GDL | Pt | $Et_3N$ * 3 HF | 67 | 60 | 40 |

$^{+)}$comparative

Example 4

4-fluoro-4-methyl-1,3-dioxolan-2-one (4-fluoropropylene carbonate)

4-fluoro-4-methyl-1,3-dioxolan-2-one was synthesized by electrochemical fluorination of 4-methyl-1,3-dioxolan-2-one using essentially the process of example 1. After removing the ethyl acetate by distillation the obtained reaction product showed 58% conversion of propylene carbonate. The GC analysis shows 23 area % 4-fluoro-4-methyl-1,3-dioxolan-2-one. Due to the missing GC factor for the product the selectivity towards 4-fluoropropylene carbonate can only be estimated to be higher than 40%.

The invention claimed is:

1. A process of electrochemically fluorinating an organic compound, the process comprising:

electrolyzing a liquid reaction medium in a electrochemical cell, wherein the liquid reaction medium comprises an organic compound comprising a hydrogen atom bound to a carbon atom;

the electrochemical cell comprises a cathode and an anode;

the liquid reaction medium further comprises a fluorinating agent selected from complexes of HF with amine bases;

the electrolyzing replaces the hydrogen atom of the organic compound with a fluorine atom; and the anode comprises a gas diffusion layer, wherein the gas diffusion layer comprises a fibre layer or substrate, and a microporous layer consisting of carbon particles attached to each other, and wherein the organic compound is a compound of formula (I):

(I)

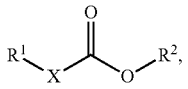

wherein

X is O, N—$R^3$ or $CR^4R^5$, $R^1$ is $C_1$-$C_6$-alkyl, $C_1$-$C_6$-alkoxy-$C_1$-$C_6$-alkyl, formyl, $C_1$-$C_6$-alkylcarbonyl, or $C_1$-$C_6$-alkyloxycarbonyl, or, if X is a $CR^4R^5$ group, $R^1$ is optionally $C_1$-$C_6$-alkoxy, or if X is N—$R^3$ or $CR^4R^5$, $R^1$ is optionally $C_1$-$C_6$-alkylcarbonyloxy, $R^2$ is hydrogen, $C_1$-$C_6$-alkyl, $C_1$-$C_6$-alkoxy-$C_1$-$C_6$-alkyl, $C_6$-$C_{10}$-aryl-$C_1$-$C_6$-alkyl, $C_3$-$C_{12}$-cycloalkyl, or $C_6$-$C_{10}$-aryl, $R^3$ is hydrogen, $C_1$-$C_6$-alkyl, $C_1$-$C_6$-alkoxy-$C_1$-$C_6$-alkyl, formyl, $C_1$-$C_6$ alkylcarbonyl, or $C_1$-$C_6$-alkyloxycarbonyl, $R^4$ and $R^5$ are each independently hydrogen, $C_1$-$C_6$-alkyl, $C_1$-$C_6$-alkoxy-$C_1$-$C_6$-alkyl, or $C_1$-$C_6$-alkoxy, $R^1$ and $R^2$ and the X—(C═O)—O group to which they are bound optionally form a 5- to 7-membered heterocyclic ring optionally comprising O, S, $NR^a$ or C═O, wherein $R^a$ is hydrogen, alkyl, cycloalkyl, or aryl, and if X is a $CR^4R^5$ group, $R^1$ and $R^4$ and the carbon atom to which they are bound optionally form a carbocyclic ring of from 3 to 7 members.

2. The process according to claim 1, wherein the fluorinating agent comprises a HF-complex which comprises a polyhydrofluoride complex of a trialkylamine or a tetraalkylammoniumfluoride.

3. The process according to claim 1, wherein the fluorinating agent comprises a HF-complex which comprises $(C_2H_5)_3N.3\ HF$.

4. The process according to claim 1, wherein the cathode is a gas diffusion layer electrode, a Pt electrode, a Pb electrode, a steel electrode, or a Ni electrode.

5. The process according to claim 1, wherein the liquid reaction medium does not comprise any additional solvents or additives.

6. The process according to claim 1, wherein a current density of the electrolyzing is from 10 to 250 $mA/cm^2$.

7. The process according to claim 1, wherein selectivity, conversion rate, or both are greater than in an otherwise-identical process wherein the anode does not comprise the gas diffusion layer.

8. The process according to claim 7, wherein the organic compound comprises ethylene carbonate and wherein a fluorination product of the electrolyzing comprises 4-fluoroethylene carbonate.

9. The process according to claim 7, wherein the organic compound comprises propylene carbonate and wherein a fluorination product of the electrolyzing comprises 4-fluoropropylene carbonate.

10. The process according to claim 1, wherein the gas diffusion layer does not comprise a catalyst.

11. The process according to claim 1, wherein a molar ratio of the fluorinating agent to the organic compound is in a range from 1:1 to 99:1.

12. The process according to claim 1, wherein a molar ratio of the fluorinating agent to the organic compound is in a range from 50:25 to 99:1.

* * * * *